US005337948A

United States Patent [19]

Newsome et al.

[11] Patent Number: 5,337,948

[45] Date of Patent: Aug. 16, 1994

[54] HALF-CARTON STRUCTURE AND METHOD OF FORMING SAME

[75] Inventors: Reginald W. Newsome, Richmond; James A. DeBlasio, Midlothian; Robert E. Talley, Chester; John M. Adams, Mechanicsville; Christopher N. Chance; Donald H. Evers, both of Richmond; William C. Harris, Midlothian; Michael A. Kirby, Trevilians, all of Va.

[73] Assignee: Philip Morris Incorporated, New York, N.Y.

[21] Appl. No.: 79,101

[22] Filed: Jun. 17, 1993

[51] Int. Cl.[5] ..... B65D 5/48

[52] U.S. Cl. ..... 229/120.15; 206/45.31; 229/162; 229/193; 493/80; 493/162; 493/910; 493/912

[58] Field of Search ..... 229/129.15, 120, 18, 229/120.24, 162, 193; 206/45.31, 256, 273; 493/79–81, 162, 910, 912

[56] References Cited

U.S. PATENT DOCUMENTS

| | | | |
|---|---|---|---|
| Re. 19,029 | 12/1933 | Sugerman | 229/29 |
| 581,339 | 4/1897 | Corkhill, Jr. | 206/256 |
| 1,016,148 | 1/1912 | Heinicke | 229/120.24 |
| 1,028,438 | 6/1912 | Cohon . | |
| 1,077,322 | 11/1913 | Ward | 206/45.31 |
| 1,464,182 | 8/1923 | Levigton | 229/120.24 |
| 1,546,074 | 7/1925 | Holland | 229/120.37 |
| 1,793,026 | 12/1933 | Sugerman . | |
| 1,911,215 | 5/1933 | Walter | 206/45.31 |
| 2,072,695 | 3/1937 | Wellman | 206/44 |
| 2,192,307 | 3/1940 | Green | 229/162 |
| 2,329,866 | 9/1943 | Van Sickels | 229/27 |
| 2,717,073 | 9/1955 | Young | 229/120.24 |
| 2,804,254 | 8/1957 | Ness | 229/28 |
| 2,983,372 | 5/1961 | Amatel et al. | 206/65 |
| 3,051,305 | 8/1962 | Houle | 206/45.34 |
| 3,066,843 | 12/1962 | Johnson | 206/45.31 |
| 3,278,016 | 10/1966 | Conti | 206/48.5 |
| 3,536,246 | 10/1970 | Rosen | 229/16 |
| 3,596,758 | 8/1969 | Phillips, Jr. | 206/48.5 |
| 3,721,335 | 8/1971 | Grant | 206/48.5 |
| 4,089,457 | 5/1978 | Wood et al. | 229/15 |
| 4,095,735 | 6/1978 | Stone | 229/39 R |
| 4,204,630 | 5/1980 | Focke | 229/120.15 |
| 4,738,359 | 4/1988 | Phillips, Jr. | 206/256 |
| 4,925,087 | 5/1990 | Ostrander | 229/120.15 |

FOREIGN PATENT DOCUMENTS

| | | | |
|---|---|---|---|
| 822374 | 11/1951 | Fed. Rep. of Germany . | |
| 2443232 | 3/1976 | Fed. Rep. of Germany | 229/120.15 |
| 1116913 | 5/1956 | France | 206/45.31 |
| 349034 | 5/1931 | United Kingdom . | |
| 898656 | 6/1962 | United Kingdom | 229/120.15 |

*Primary Examiner*—Gary E. Elkins
*Attorney, Agent, or Firm*—Kevin B. Osborne; James E. Schardt; Charles E. B. Glenn

[57] ABSTRACT

A half-carton container for cigarette packs, formed from a unitary blank, having windows formed in a first wall to display and facilitate the removal of the contained goods and having partitions hingedly attached to the first wall and secured to a second wall to support the half-carton structure and to partition and hold in place the contained goods. The half-carton container can be paired with another half-carton by attachment or by placing in a full-carton container such that they can be tax-stamped as a pair and later easily separated for sale as independent units.

7 Claims, 4 Drawing Sheets

HALF-CARTON STRUCTURE AND METHOD OF FORMING SAME

BACKGROUND OF THE INVENTION

This invention relates to a half-carton that contains goods to be transported and a method of forming the half-carton. The half-carton may be used individually, attached to another half-carton, or placed in one larger carton with a second half-carton. More particularly, this invention relates to a half-carton that contains cigarette packs, wherein the half-carton may be sold or displayed individually, attached to another half-carton, packed with another half-carton in a larger carton, or used to display, hold and sell individual cigarette packs. The packaging of this invention may be used with standard cigarette tax-stamping equipment.

Any type of packaging should be sturdy to protect the goods it contains. It is also advantageous that the packaging be attractive for advertising purposes and identify the goods it contains. This is especially true for goods such as cigarettes. Cigarettes are often stored and displayed behind a counter, and consumers often identify the cigarettes they desire by the sight of the packaging.

It would be desirable to provide consumers with the option of purchasing a half-carton instead of a full-sized, standard carton. Consumers also often purchase parts of the contents of a carton, such as individual cigarette packs, and the packaging of the carton should preferably also enable the retailer to provide individual packs from the carton with ease. The opened carton or half-carton with some of the packs removed should still hold the remaining packs without those packs falling out or falling over within the packaging. Also, packaging that allows the retailer and consumer to identify and inventory the contents at a glance is advantageous.

In previously known packaging schemes, it may be difficult to remove single parts of the contents, such as single cigarette packs, without disassembly of the packaging. Moreover, the retailer and the consumer may have to look inside each carton or half-carton to identify and inventory the contents. Furthermore, the contents could also often fall out or fall over within the packaging, sometimes getting stuck, when the half-carton is not full. In addition, the contents may be difficult to remove from the packaging, especially when the carton or half-carton is full.

A previously known carton was formed with sections cut out from the walls, forming windows. Although this method enabled the goods within the carton to be seen from without, it was wasteful in that the sections cut from the walls were often not used and were discarded, resulting in a waste of material. Also, the contents shifted and often toppled over.

Other previously known cartons reduce the shifting and toppling of the contents by inserting rigid divider or partition inserts between the contents. This carton, however, required extra paperboard or other packing materials for the divider inserts. In addition, this carton required that the insert be formed separately from the main carton and be inserted into the carton prior to packing of the contents.

Still other previously known cartons attempted to combine the window feature and the divider feature. Examples of such cartons are presented in U.S. Pat. Nos. 2,804,254 (Ness), 2,983,372 (Amatel et al.) and 4,029,457 (Wood et al.). Each of these provided a carton or other container having cut-outs formed in their walls such that the cutouts could be folded into the inside of the cartons, thereby forming windows in the carton walls and partitions for the carton's contents. These methods produced less waste by providing a unitary blank with the necessary cut and fold lines.

Although the windows and partitions of these cartons were formed from a single carton blank, the container structure formed therefrom was significantly weakened by the cutouts from the walls. Because one or more carton walls had windows/partitions cut out from them, they were thereby weakened, leaving the cartons much less sturdy. This lack of sturdiness and support could lead to the cartons or the goods in the cartons being crushed or otherwise deformed during shipping.

In a particular application, a standard cigarette carton contains two parallel rows of five packs each. In each row of the "full-carton" or "standard carton," the five packs are typically positioned with one of their ends facing upward and each of the packs aligned side-by-side in a $1\times5$ pack configuration. Two such rows form a standard $2\times5$ pack carton. Each $1\times5$ pack row could be packaged separately for sale as a five-pack half-carton.

Most states and foreign countries require that tax stamps be affixed to cigarette packs prior to sale. Tax-stamping is typically done at the distributor level, after the cigarette cartons have already been filled with cigarette packs by the manufacturer, temporarily closed and shipped to the distributor. Temporarily closing the cartons may be done in many ways, such as by folding the top flaps of the cartons down over the cigarette boxes and releasably fastening the flaps in the closed position. Automated tax-stamping equipment has been developed to plow open the temporarily closed cartons, apply the tax-stamps of that jurisdiction to the ends of the cigarette packs and then reseal the cartons for distribution to retail stores. Such tax-stamping equipment is generally commercially available and is well known in the art.

Existing automated tax-stamping equipment, however, is geared for simultaneously stamping ten cigarette packs in the standard $2\times5$ pack carton configuration. Accordingly, in order to use existing tax-stamping equipment, separately packaged half-cartons must be configured in parallel pairs such that two half-cartons can be sent through standard tax-stamping equipment as a single $2\times5$ pack carton unit.

The two half-cartons must be held together securely and without slipping to ensure that the tax-stamping equipment will function properly and that the two half-cartons will not be sheared apart by the tax-stamping equipment. In addition, the half-cartons must be easily separable so that each half-carton may be displayed or sold by itself at the retail level.

It would be desirable to be able to provide an improved packaging carton that uses automated equipment.

It would be further desirable to be able to provide an improved packaging carton wherein the carton's contents are visible to the eye for inventory, identification and advertising of the contents.

It would be further desirable to be able to provide an improved packaging carton wherein the carton's contents are easily removable and the carton's contents are held in place.

It would be still further desirable to be able to provide an improved packaging carton wherein the carton structure is further supported by sections of the carton blank.

It would be further desirable to be able to provide an improved packaging carton that forms a display unit.

It would be also desirable to be able to provide an improved carton that makes use of existing equipment for tax-stamping or other manipulations to one of the ends of the goods in the cartons and requires minimal modifications of existing equipment for making half-cartons and for placing goods into them.

It would be further desirable to be able to provide a half-carton of cigarettes so that two half-cartons may be securely paired together for tax-stamping with standard tax-stamping equipment and later may be easily separated at the retail level for display purposes and to enable the consumer to purchase only a half-carton rather than a full-carton.

SUMMARY OF THE INVENTION

It is an object of this invention to provide improved packaging that can be done with automated equipment.

It is still a further object of this invention to provide an improved packaging carton that can be attractively displayed for retail sale.

It is still a further object of this invention to provide a packaging carton wherein its contents are visible to the eye for inventory, identification and advertising of its contents.

It is still a further object of this invention to provide an improved packaging carton wherein the contents are easily removable and the contents are held in place.

It is yet a further object of this invention to provide an improved packaging carton wherein the carton structure is further supported by sections of the carton blank.

It is still a further object of this invention to provide an improved packaging carton that forms a display unit.

It is another object of this invention to provide an improved carton that makes use of existing equipment for tax-stamping or other manipulations to one of the ends of the goods in the cartons and requires minimal modification of equipment for making cartons and for placing goods into them.

It is a further object of this invention to provide an improved cigarette carton wherein two half-cartons may be held securely together for tax-stamping with standard tax-stamping equipment and later either may remain securely together or may be separated and sold individually to consumers.

These and other objects of the invention are accomplished in accordance with the principles of this invention by providing a half-carton wherein the contents are visible from the outside, the contents are easily removable, and the contents are held in place. The half-carton is formed from a blank that has certain cuts made into its panels and then folding the blank into a half-carton. The cuts form flaps, walls and tabs that form windows and partitions for the goods contained within the half-carton and also are attached to the far wall in order to provide support and structure for the half-carton. An assembled half-carton is then filled with goods such as cigarette packs. Two filled half-cartons can be placed in a larger carton or attached to one another. The half-carton can also be used individually.

The consumer can purchase this half-carton individually. If previously joined, two half-cartons may be easily separated without crushing, folding, tearing or otherwise deforming the carton, merely by lifting one half-carton out of a larger carton in the one embodiment, or by disassembling the attachment means between the two half-cartons that are attached to one another in another embodiment. The retailer may display the larger carton with two half-cartons inside, two paired half-cartons attached to one another, the individual half-cartons, or some combination of any of these. The half-carton provides an attractive display and advertisement for their contents. Portions of the contents are visible to the eye. Individual parts of the contents can be easily removed and sold from each half-carton, and partition flaps keep the contents of a partially empty half-carton in place.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

In the preferred embodiment of the present invention, a paperboard blank is folded into a half-carton and is either used individually or is placed in a larger or a standard 2×5 carton or attached to another half-carton to provide a versatile, displayable container structure. Paperboard is preferred, although other suitable materials such as paper, plastic or the like may be employed. Each paperboard blank has certain cuts and is folded to form a half-carton. Certain areas of a blank may be glued or secured by some other fastening means to other areas of the blank. Certain cut areas of the part of the blank that form the half-carton front wall are used to form flaps and tabs to partition the cigarette packs from each other and to support and strengthen the half-carton. These cut areas also leave open areas or windows in the front wall through which the contents of the half-carton are visible. Each half-carton, once assembled, is preferably filled with five packs of cigarettes.

After two half-cartons are filled with packs, they are placed in a larger carton. In another embodiment, two half-cartons are attached to one another. A half-carton can also be used individually. The entire construction and filling of the packaging and shipping can be done with automated equipment. At the retail level, if the consumer chooses to purchase only a half-carton, one half-carton can be lifted out of the larger carton in one embodiment or separated from another half-carton in another embodiment. The retailer can display the larger carton, the two paired half-cartons, or individual half-cartons. The individual half-carton, with its contents visible, provides an advertisement and display of the packs that it contains. Identification and inventory of the contents may be done at a glance. Furthermore, individual goods, such as cigarette packs, can be easily removed and sold from the half-carton without disassembly of the packaging. Partition flaps within the half-carton hold the contents in place when some of the contents have been removed.

Figure 1:
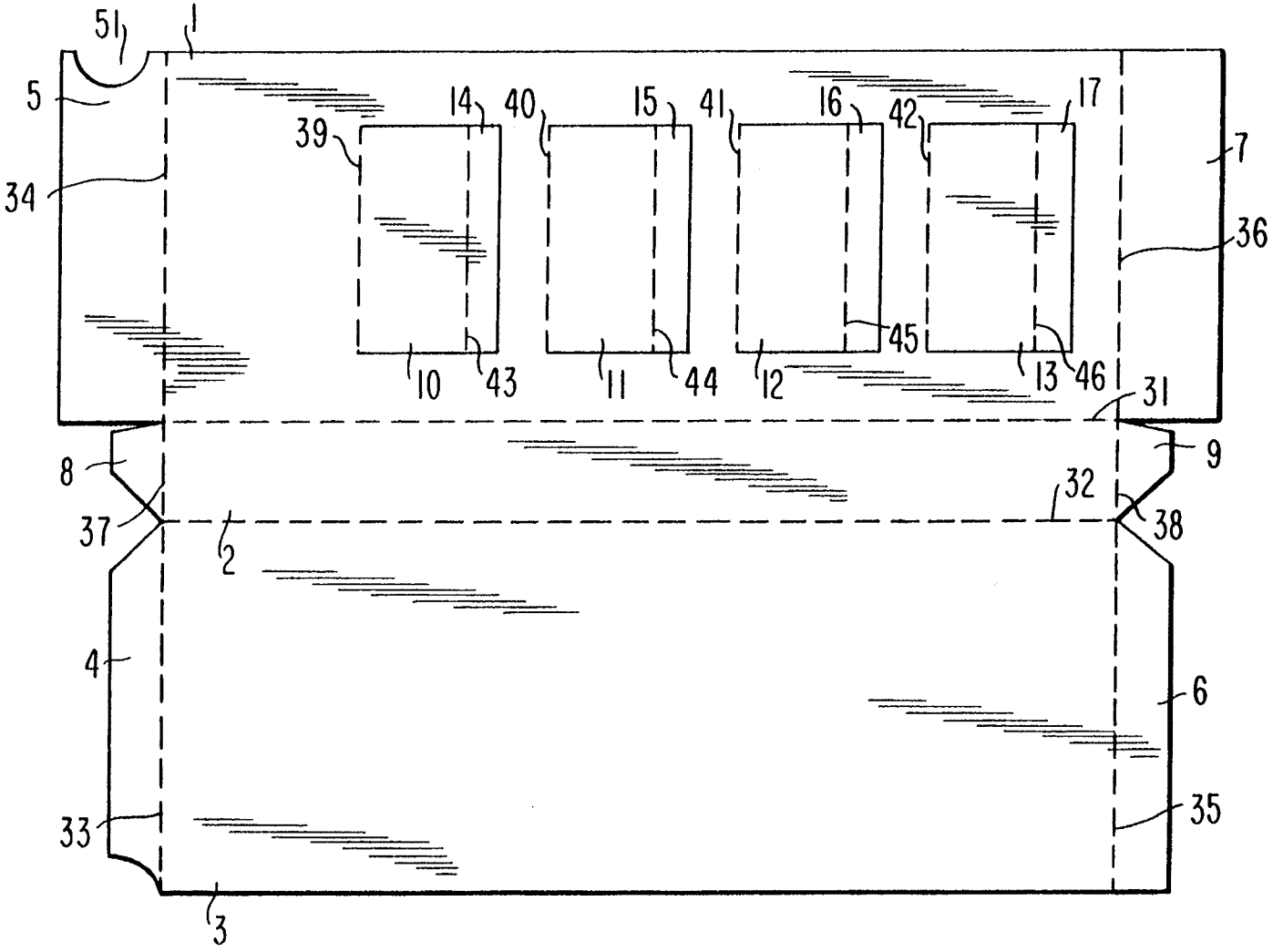
FIG. 1 shows a single blank of paperboard that, when folded along the dashed fold lines, forms a half-carton containing five cigarette packs aligned side-by-side.

In a preferred embodiment of this invention, a blank of paperboard is fabricated as shown in FIG. 1. Panels of the blanks are separated from each other by scored fold lines, indicated in FIG. 1 by dashed lines, or by cut lines, indicated in FIG. 1 by solid lines. These scored lines and cut lines are formed by any suitable conventional means. The scored lines enable some of the panels to be hingedly attached to one another and thus foldable. The cut lines enable some of the panels or cut-out sections of panels to be separated from the blank at the cuts. An advantage of this invention is that the entire half-carton can be formed from one paperboard blank and without waste.

Figure 2:
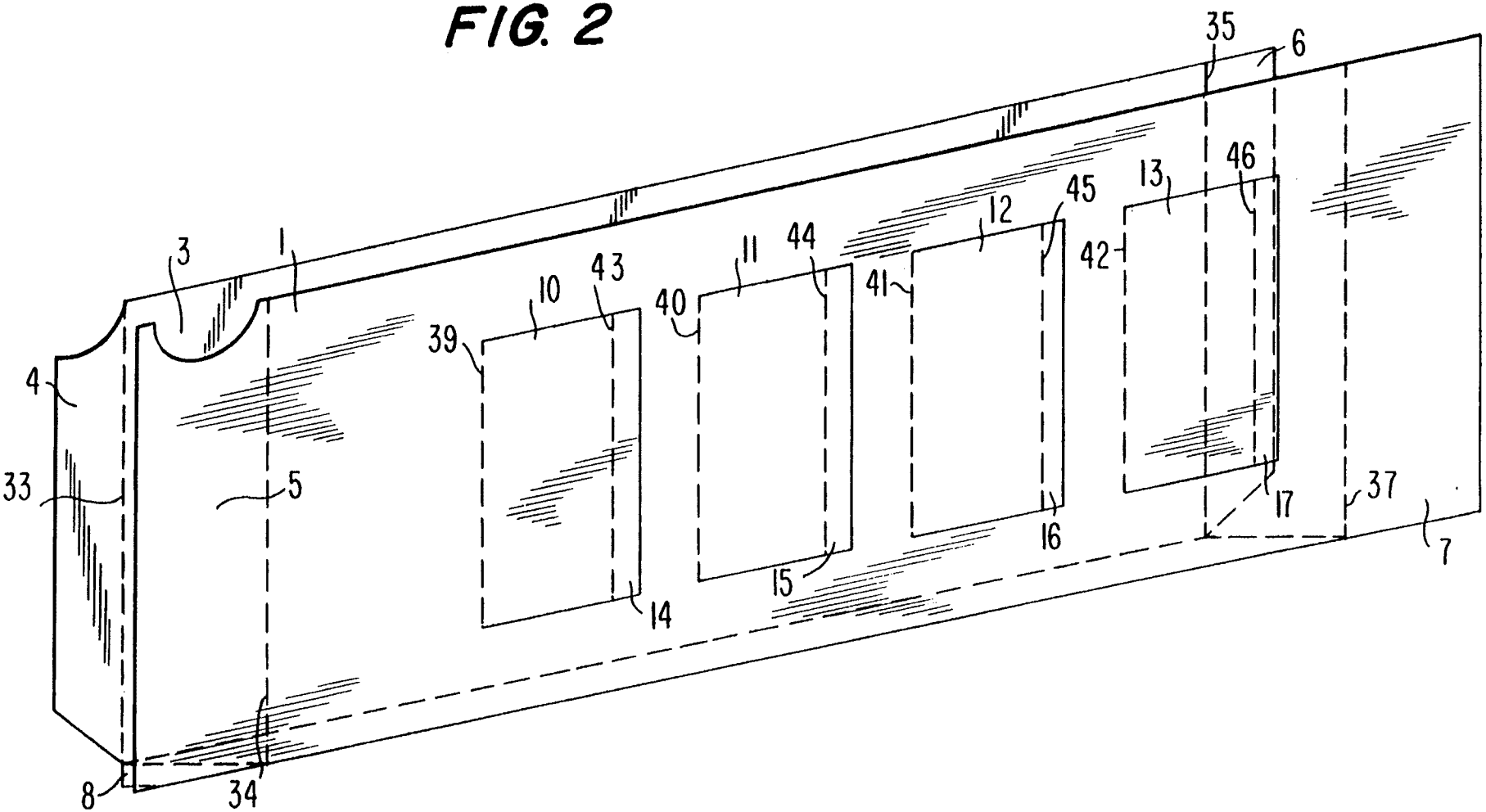
FIG. 2 shows a top side perspective view of a partially assembled half-carton.

One half-carton is assembled by folding along the dashed fold lines of FIG. 1. Front wall 1 is folded upwards along fold 31 to form a 90° angle with bottom wall 2. Back wall 3 is folded upwards along fold 32 to form a 90° angle with bottom wall 2. The half-carton assembled to this step is shown in FIG. 2.

Side flaps 4 and 6 are then folded inwards along folds 33 and 35 respectively to form 90° angles with back wall 3. Side walls 5 and 7 are folded along fold 34 and 36 respectively to form 90° angles with front wall 1 and to rest on side flaps 4 and 6 respectively. Side walls 5 and 7 can be attached to side flaps 4 and 6 respectively by glue or secured by some other fastening means. Side wall tabs 8 and 9 are then folded along folds 37 and 38, respectively, to form 90° angles with the bottom wall 2. Side wall tab 8 can be attached to side flap 4 and side wall 5, and side wall tab 9 can be attached to side flap 6 and side wall 7 by glue or secured by some other fastening means.

At the same time the cut-out sections that form partition flaps 10, 11, 12 and 13 are folded along folds 39, 40, 41 and 42, respectively, to form 90° angles with front wall 1, partition flap tabs 14, 15, 16 and 17 are folded along folds 43, 44, 45 and 46, respectively, to form 90° angles with the partition flaps and to rest on back wall 3. The width of each partition flap 10–13, however, must be approximately equal to the short dimension of the bottom wall 2 so that each partition flap 10–13 will neither fall short of nor extend past the back wall 3. Partition flap tabs 14–17 can be attached to back wall 3 by glue or secured by some other fastening means to back wall 3.

Figure 3:
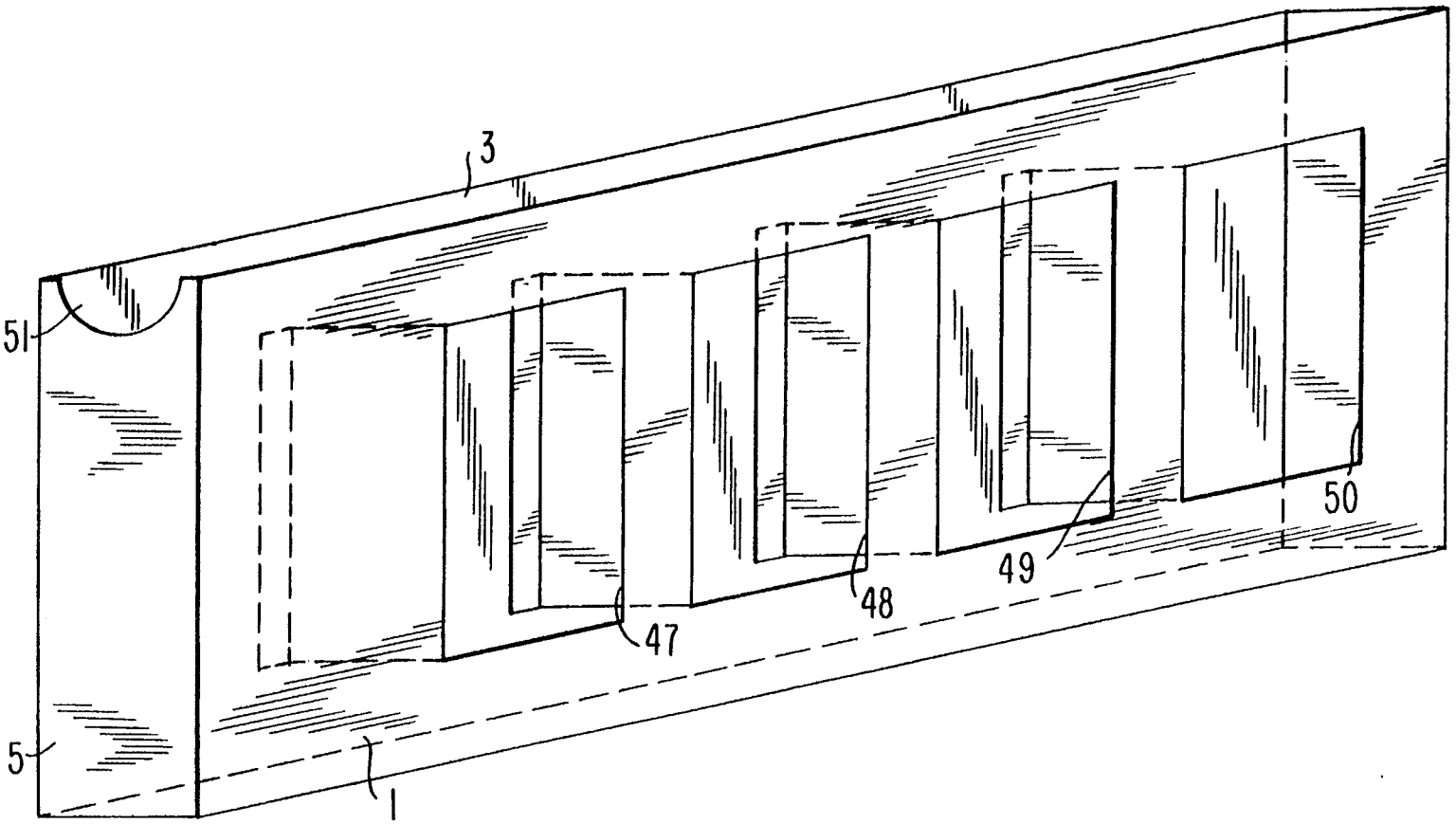
FIG. 3 shows a top side perspective view of an assembled half-carton.

The partition flaps 10–13 when attached to back wall 3 via partition flap tabs 14–17 provide support for the half-cartons and a partition to hold the goods in place, especially when some but not all of the goods are removed. The partition flaps 10–13 when folded also create a window through which the goods contained are visible, making the half-carton a display unit. The shape of the partition flap and the resulting window is preferably rectangular, but other shapes may be used. The assembled half-carton is shown in FIG. 3. As was mentioned previously, an advantage of this invention is that the half-carton is formed from one blank without waste. This invention wastes little to no paperboard since the "cut-out" for each window becomes a partition flap.

The folding of the various components of the blank and the assembly of the half-carton is presented herein in a particular order. However, it will be clear to someone skilled in the art that a different order of folding or assembly will produce a comparable effect.

Figure 4:
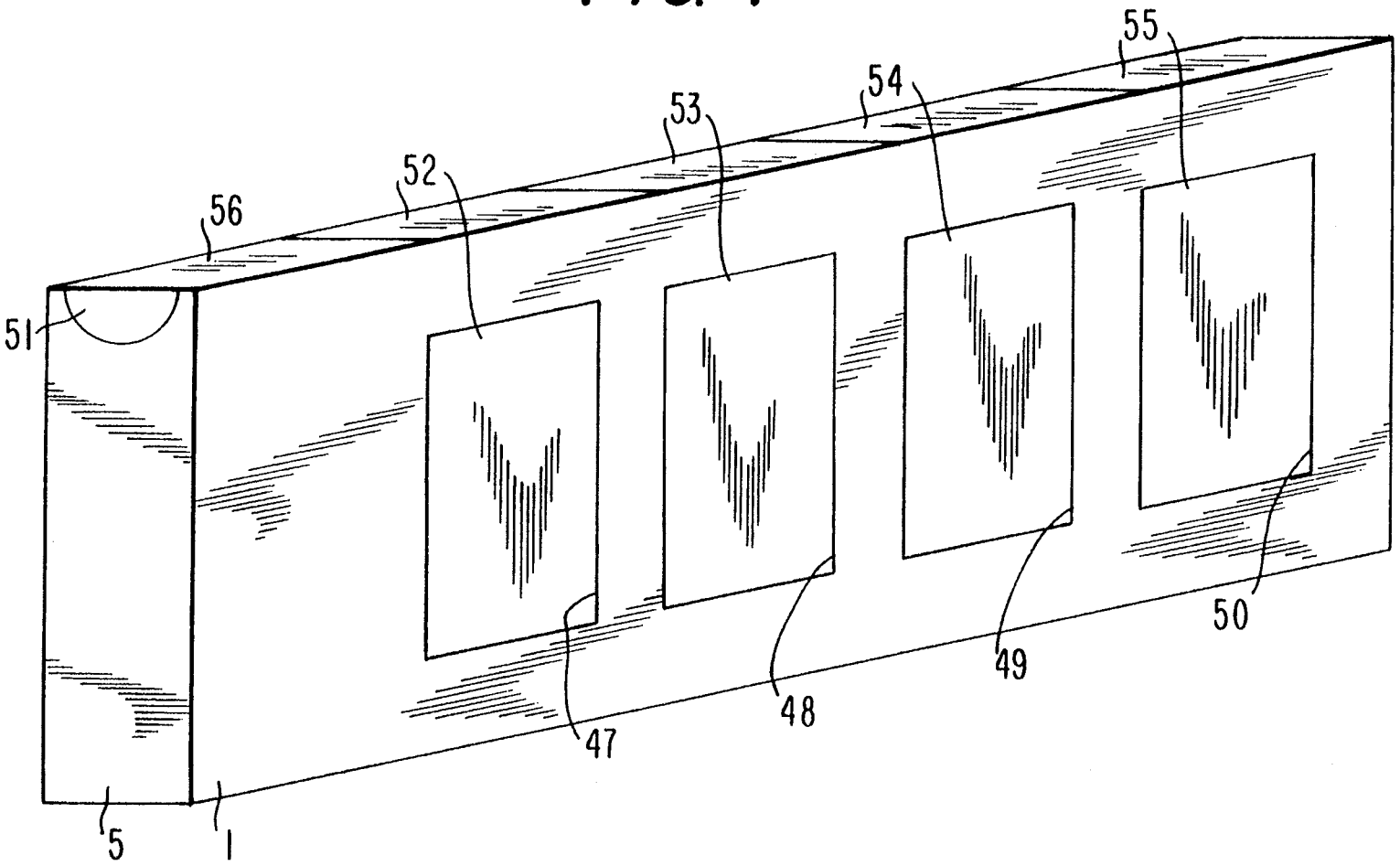
FIG. 4 shows a top side perspective view of an assembled half-carton filled with five cigarette packs.

The half-carton, when assembled, is ready to be filled with goods, such as five cigarette packs. FIG. 4 shows the resulting half-carton tray when filled with cigarette packs 52–56. Four individual packs, 52, 53, 54 and 55, are removable from the top of the half-carton by pushing a pack through the top of the half-carton by contacting and pushing the pack through windows 47, 48, 49 or 50, respectively, on the front wall of the half-carton. The fifth pack 56 is removable by pushing the pack through the top of the half-carton by contacting and pushing the pack through the notch 51 cut from the top of side wall 5. Notch 51 thus makes goods contained in the half-carton visible to the eye and removable.

Although the tabs and flaps disclosed are described and depicted in certain numbers, the tabs and flaps can be of different numbers, sizes or shapes and in different locations on the half-carton. The number, size, shape, and position of the tabs and flaps should be chosen with consideration of the size, shape and number of the particular packs or goods to be packaged.

Two half-cartons, each containing five cigarette packs in a 1×5 pack side-by-side configuration, can be put into a standard 2×5 ten-pack carton in the standard 2×5 pack carton configuration.

Typically, in the embodiment using the standard 2×5 carton with two half-cartons inside, the standard 2×5 carton is temporarily closed and lightly fastened at its top by the manufacturer so that the tax-stamping equipment can plow open the top flaps in order to provide access to one of the ends of the cigarette packs for tax-stamp application. After tax-stamping, the tax-stamp equipment securely fastens the standard 2×5 carton at its top so that the tops will remain securely closed during later shipping and handling.

The two half-cartons can also be attached to one another using glue, staples, rubber bands, tape, film, wrap or some other fastening means. This may include a paperboard structure to add support. For example, in one such embodiment, one or more strips of tacky adhesive can be applied to the back wall of one half-carton tray. A second half-carton tray can be pressed against the tacky adhesive thereby attaching two half-carton trays to one another. These two attached half-cartons can then be tax-stamped as a standard 2×5 carton would be with existing standard tax-stamping equipment.

After tax stamping, at the retail level, a consumer has the options of purchasing the two half-cartons for a ten-pack full-carton of cigarettes, of purchasing only one five-pack half-carton, or, finally, of purchasing an individual pack from a single half-carton. The retailer can choose to display the standard 2×5 carton with two half-cartons inside or two half-cartons attached to one another. The retailer can also display the individual half-cartons with their contents visible. Individual packs are removable from the top of the half-cartons by pushing on a pack through a window on the front wall or through the notch on the side wall.

The half-carton or two half-cartons attached to one another can be wrapped with a clear or transparent film or wrap such as polyethylene or other suitable material. If wrapped before tax-stamping, the wrap should not cover one of the ends of the packs in order to provide the tax-stamping equipment access to one of the ends of the packs. If wrapped after tax-stamping, or if no tax-stamping is to be performed, the wrap may cover the entire half-carton, the entire dual half-carton embodiment having two attached half-cartons, or the standard 2×5 full carton with two half-cartons inside.

Thus, a novel half-carton, a method of packaging in a half-carton, and a resulting full-carton, are provided. One skilled in the art will appreciate that the present invention can be practiced by other than the described embodiments, which are presented for purposes of illustration and not of limitation, and the present invention is limited only by the claims that follow.

What is claimed is:

1. A container structure comprising:

a front wall having a plurality of cut-out sections foldably and vertically attached thereto, each of said cut-out sections having a flap tab foldably and vertically attached to the cut-out section;

a back wall parallel to and substantially the same size as the front wall; and a bottom wall perpendicular to and attached to both the front wall and the back wall and having a width substantially equal to the width of the cut-out sections; wherein:

the cut-out sections are folded such that they are perpendicular to the front wall and extend towards the back wall; and the flap tabs are folded such that they are parallel to and resting against the back wall.

2. The structure of claim 1 further comprising means for fastening the flap tabs to the back wall.

3. The structure of claim 2 further comprising:

a first side wall foldably and attached to a first side edge of the front wall, said first side wall also attached to a first side edge of the back wall, said first side wall having a notch cut from the top; and a second side wall attached to a second side edge of the front wall, said second side wall also attached to a second side edge of the back wall.

4. A container structure that holds goods to be transported, said structure comprising:

a half-carton container having a front wall, a first side wall having a notch through which goods contained in the half-carton container are visible and through which the goods can be contacted to facilitate their removal from the half-carton container, a second side wall, two side flaps, a back wall, a bottom wall, a plurality of partition flaps that hold the goods in place, each partition flap having one of a plurality of partition flap tabs, each partition flap tab being secured to the back wall by fastening means, and a plurality of windows through which the goods contained in the half-carton container are visible and through which the goods can be contacted to facilitate their removal from the half-carton container; wherein:

the back wall is parallel to and substantially the same size as the front wall;

the two side flaps are each attached to a different side edge of the back wall;

the bottom wall is perpendicular to and attached to the front wall and the back wall;

the plurality of partition flaps are attached to the front wall;

the first side wall having the notch is attached to one side edge of the front wall; and the second side wall is attached to a different side edge of the front wall.

5. The structure of claim 1 or 4, wherein the structure is formed from a unitary blank.

6. A method of forming a container structure, said method comprising the steps of:

providing a paperboard blank having a plurality of panels separated from each other by a first plurality of scored fold lines, wherein one of said panels is a front wall panel having a plurality of cut-out sections, each of said cut-out sections is attached to said front panel by one of a second plurality of scored fold lines, and each of said cut-out sections has a flap tab that is attached to one of the cut-out sections by one of a third plurality of scored fold lines;

folding the paperboard blank along the first plurality of scored fold lines to form a half-carton container having a front wall and a back wall of substantially the same size, the front wall being formed from said front wall panel having said plurality of cut-out sections;

folding each of said plurality of cut-out sections into said container along a respective one of the second plurality of scored fold lines to form a respective partition flap, such that a plurality of windows is formed in said front wall from said cut-out sections;

folding the flap tab on each cut-out section along a respective one of the third plurality of scored fold lines such that the flap tabs are resting against the back wall.

7. The method of forming a container structure of claim 6, further comprising the step of:

fastening the flap tabs to the back wall by fastening means.

* * * * *